United States Patent [19]

Smith

[11] Patent Number: 5,075,827

[45] Date of Patent: Dec. 24, 1991

[54] INDIRECT LIGHT FIXTURE AMPLIFICATION REFLECTOR SYSTEM

[76] Inventor: David H. Smith, 909 Delray, Garland, Tex. 75043

[21] Appl. No.: 606,879

[22] Filed: Oct. 31, 1990

[51] Int. Cl.[5] ..... F21V 7/02; F21S 3/02

[52] U.S. Cl. ..... 362/221; 362/225; 362/346; 362/347; 362/349

[58] Field of Search ..... 362/221, 225, 298, 297, 362/247, 249, 346, 347, 349

[56] References Cited

U.S. PATENT DOCUMENTS

| | | | |
|---|---|---|---|
| 2,335,218 | 11/1943 | Vacha | 362/221 |
| 2,647,202 | 7/1953 | Elmer | 240/25 |
| 2,887,567 | 5/1959 | Dameral | 362/225 |
| 2,921,181 | 1/1960 | Elmer | 240/25 |
| 3,053,560 | 9/1962 | Flanigen et al. | 292/99 |
| 3,331,960 | 7/1967 | Elmer | 240/103 |
| 3,358,553 | 12/1967 | Elmer | 88/24 |
| 3,389,246 | 6/1968 | Shemitz | 240/2 |
| 3,390,262 | 6/1968 | Elmer | 240/41.37 |
| 3,398,272 | 8/1968 | Elmer | 240/41.35 |
| 3,428,397 | 2/1969 | Elmer | 355/11 |
| 3,471,231 | 10/1969 | Elmer | 355/70 |
| 3,494,693 | 2/1970 | Elmer | 353/55 |
| 3,526,459 | 9/1970 | Elmer | 355/67 |
| 3,679,893 | 7/1972 | Shemitz et al. | 240/103 |
| 3,950,638 | 4/1976 | Kent et al. | 240/40.1 |
| 4,173,034 | 11/1981 | Shemitz | 362/127 |
| 4,729,075 | 3/1988 | Brass | 362/217 |
| 4,760,505 | 7/1988 | Cole, Jr. | 362/225 |
| 4,975,812 | 12/1990 | Cole, Jr. | 362/346 |
| 4,977,490 | 12/1990 | Davies | 362/249 |

FOREIGN PATENT DOCUMENTS

| | | | |
|---|---|---|---|
| 2394747 | 2/1979 | France | 362/221 |
| 14719 | of 1912 | United Kingdom | 362/347 |
| 976936 | 12/1964 | United Kingdom | 362/225 |

*Primary Examiner*—Ira S. Lazarus
*Assistant Examiner*—Y. Quach
*Attorney, Agent, or Firm*—Ross, Howison, Clapp & Korn

[57] ABSTRACT

A luminaire of the indirect lighting type includes an indirect light fixture amplification reflector system consisting of plural opposed compound asymmetric reflectors mounted on a common longitudinal axis and used in combination with each other to produce a uniformly enlarged singular light distribution pattern when directed towards a secondary reflective surface such as the ceiling of an interior room cavity. The reflector functions to distribute the light pattern in a primarily outward rather than upward manner thereby reducing the number of luminaries required for efficient illumination. The reflector shape prevents direct exposure of the lamp source to the secondary surface thereby decreasing the mounting distance required between the luminaire and the secondary surface being illuminated, as well as providing for a more even illumination and the widest possible spacing ratio between luminaries. The reflector system may be housed in a reflector enclosure which functions as a secondary diffuse reflector on both its interior and exterior surfaces.

16 Claims, 4 Drawing Sheets

INDIRECT LIGHT FIXTURE AMPLIFICATION REFLECTOR SYSTEM

TECHNICAL FIELD OF THE INVENTION

The present invention relates to lighting systems, and more particularly to a luminaire for an indirect lighting system.

BACKGROUND OF THE INVENTION

The present invention relates to luminaries which are used with linear lamp sources beneath relatively low ceilings such as found in offices, schools, and shops. Indirect light fixtures are commonly provided when the use of direct types of lighting fixtures would introduce the element of unwanted glare and primary light source reflection onto such surfaces as the screens of visual display terminals, reading material, and outwardly displayed merchandise. Light fixtures for such use take many different forms and shapes which are determined by the aesthetic and performance criteria that are required. In a broad sense all or most of such indirect fixtures embody a single upwardly facing reflector assembly housed within a separate or integral shroud or enclosure which is then supported vertically below the ceiling surface of the room cavity which is to be illuminated.

It is known from Lambert's law that the illumination on a surface is proportional to the cosine of the angle of the incidence of the light ray, and that diffuse surfaces such as a white ceiling diffuse or scatter light incident from any angle and reflect it throughout a complete hemisphere in a generally cosine pattern. Further, it is known from the inverse square law with its cosine correction, $E=(I/d^2)\cos\theta$, defining the magnitude of illumination E at a point on a plane, that equality of the illumination at all points on the plane theoretically requires that a luminaire provide thirteen times more candlepower at a point approximately 2.15 times mounting height away on the plane to be illuminated than is provided at nadir. Despite this understanding of essential combined requirements for controlled, uniform, indirect illumination, attempts to design luminaries to take full advantage of the aforementioned principles have not been entirely successful.

A primary reason for the lack of success has been the inefficient shape, size, and composition of current reflector designs which are limited to the extent that the luminaries overall visual appearance often dictates the reflectors design criteria. It is generally accepted that an indirect luminaire should not exceed a maximum to minimum luminance ratio of more than 10 to 1, nor exceed a maximum footlambert level of 500 when measured above the fixture on the secondary ceiling surface. Failure to adhere to the aforementioned requirements results in uneven illumination as well as objectionable glare being produced.

Existing attempts to address the above mentioned performance criteria have used a greater quantity of smaller, lower brightness luminaries with upwardly exposed open lamp sources. This solution generally results in adequate uniformity and brightness levels being achieved at the expense of higher initial cost and increased energy consumption. Another method used has been to employ a luminaire with a lens or diffuser to shield and diffuse the lamp source from direct exposure to the ceiling surface. This solution decreases the lamp efficiency by a minimum of 8% to 10% thereby increasing the number of luminaries required for even illumination as well as increasing the initial cost of the luminaire. The lensed solution further contributes to the complexity and time required to maintain and clean the luminaire. Another method uses a lesser quantity of larger, higher brightness luminaries which typically utilize an HID (high intensity discharge) lamp source mounted well below the secondary surface which is to be illuminated. Negative features of the HID system include high initial cost, as well as an excessive mounting distance between the luminaire and the secondary surface, such distance being required to remain within acceptable brightness and uniformity criteria.

As discussed above, a common problem encountered with the use of indirect luminaires of this general type, i.e., the open or lensed lamp source being directly exposed to the secondary reflective surface, is that an inordinately high number of luminaires and/or lamps are required to provide a specified level of even illumination on the ceiling or secondary surface. As further discussed above, the present fixtures should be suspended a minimum of 9 inches or more from the ceiling surface in order to remain within the acceptable brightness criteria. The present trend towards energy conservation has established the need for an efficient, cost effective indirect luminaire that can achieve the required levels of uniform illumination by utilizing a significantly smaller number of luminaires and/or lamps than would otherwise be required by use of conventional indirect luminaires.

A need has thus arisen for an indirect light fixture having increased efficiency with low cost of manufacture and operation.

SUMMARY OF THE INVENTION

The present invention is concerned with both increasing the efficiency as well as lowering the overall cost of indirect light fixtures through the use of an indirect light fixture amplification reflector system.

In accordance with the present invention, a new and improved reflector system composed of plural opposed compound asymmetric reflectors mounted on a common longitudinal axis and used in combination with each other to produce a uniformly enlarged singular light distribution pattern when directed towards a secondary reflective surface such as the ceiling of an interior room cavity is provided.

In accordance with the present invention, a new and improved indirect luminaire reflector shape functions to distribute the light pattern in a primarily outward rather than upward manner thereby increasing the allowable spacing distance between luminaires while still providing superior uniformity.

In accordance with another aspect of the present invention, a new and improved indirect luminaire reflector shape functions to prevent direct exposure of the lamp source to the secondary reflective surface directly above the luminaire thereby allowing the luminaire to be mounted more closely to the secondary surface and still provide evenness of illumination.

In accordance with another aspect of the present invention, a new and improved hybrid reflector shape capable of increasing the surface area of the primary reflector without a corresponding increase in the overall linear size of the reflector housing or enclosure is provided.

In accordance with yet another aspect of the present invention, a new and improved compound reflector surface which utilizes a primary highly specular interior reflector surface in conjunction with an adjacent highly diffuse straight or generally curved exposed exterior primary reflector surface is provided.

In accordance with yet another aspect of the present invention, a new and improved reflector housing or enclosure is provided which acts as a secondary diffuse reflective surface on both its interior and exterior surface thereby minimizing beam striations caused by the specular nature of the primary reflector as well as allowing the luminaire to more readily blend in with the appearance of the ceiling or secondary reflective surface beneath which the luminaire is mounted.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
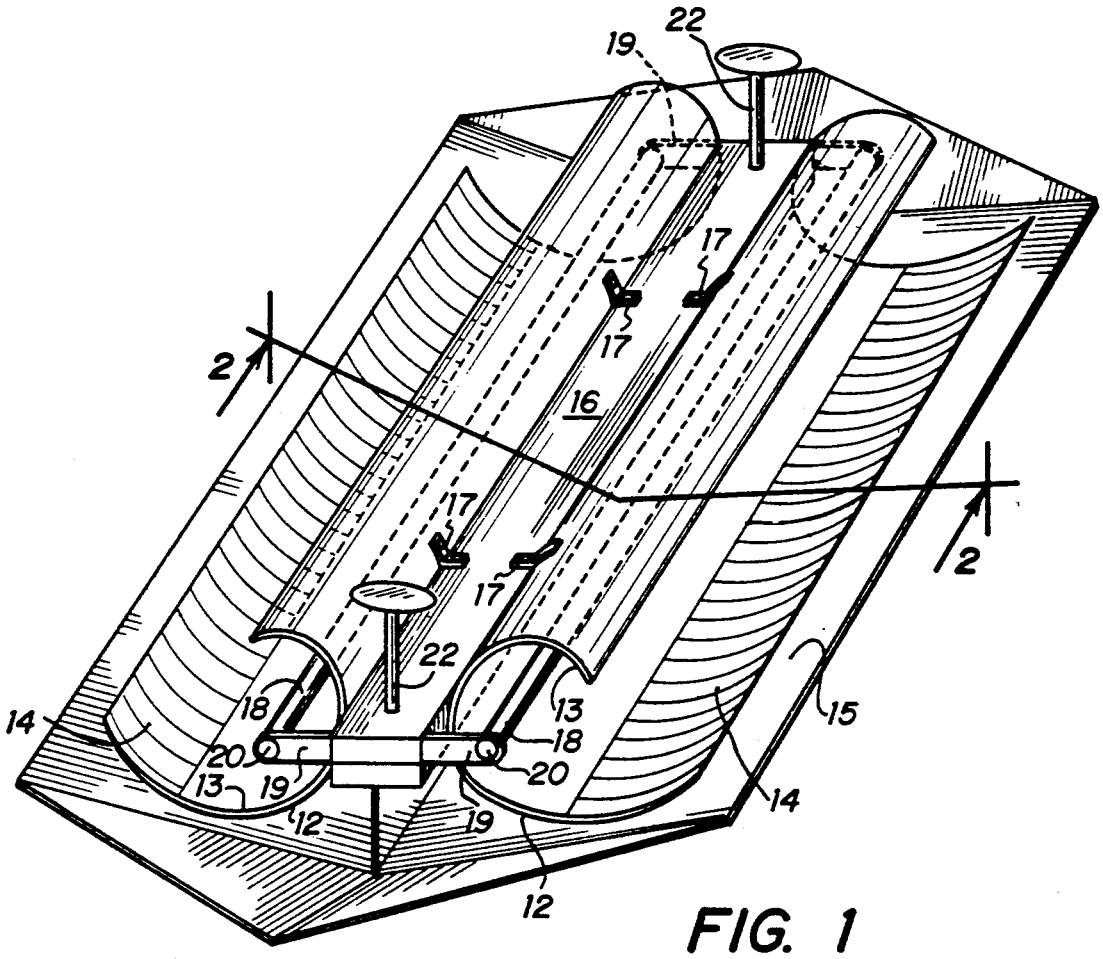
FIG. 1 is a perspective, partially fragmentary, view of the plural opposed asymmetric reflectors of the present invention.
Figure 2:
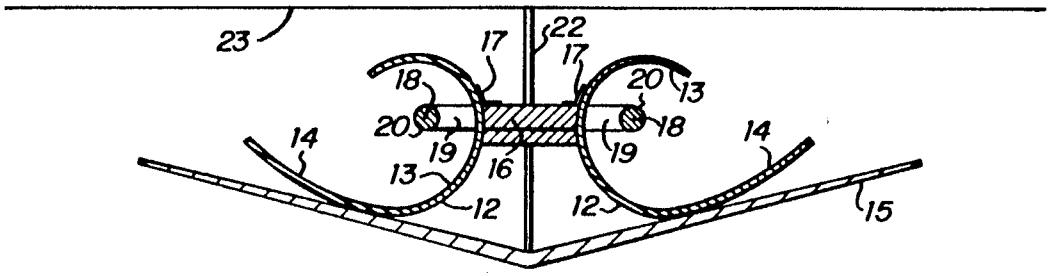
FIG. 2 is a diagrammatic elevational view of the plural opposed asymmetric reflectors shown in FIG. 1 and taken generally along sectional lines 2—2.
Figure 3:
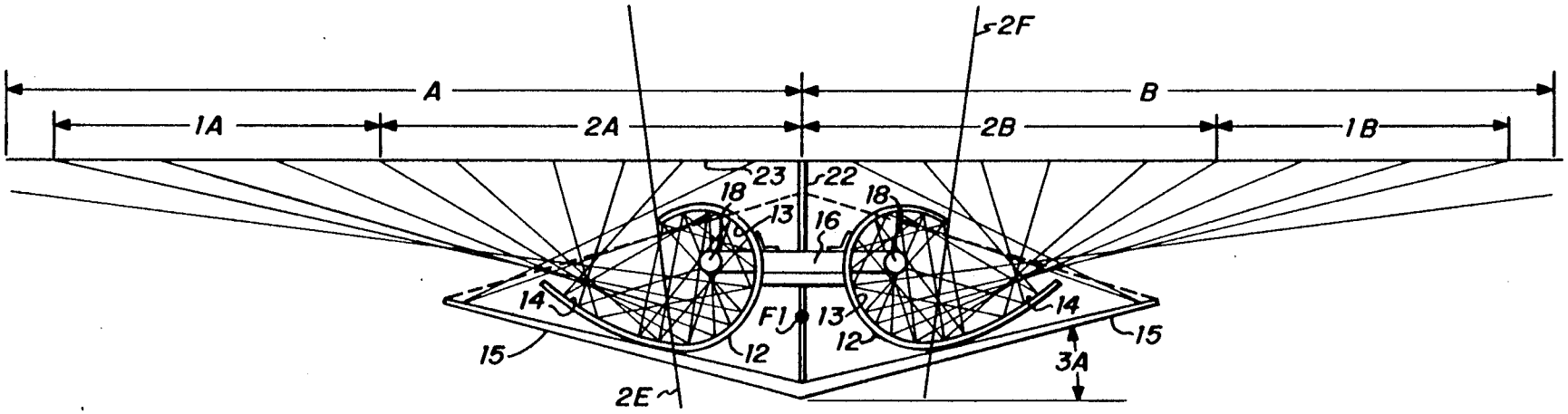
FIG. 3 is a diagrammatic view of the reflections from the plural opposed asymmetric reflectors of the present invention.
Figure 4:
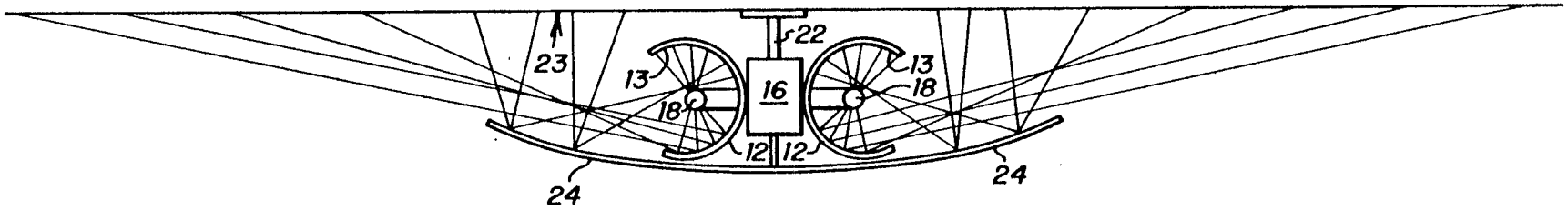
FIG. 4 is a diagrammatic view of the reflections from an addition embodiment of the present invention.

In the embodiment of the invention illustrated in FIGS. 1 to 4, plural compound reflectors 12 include specular primary reflective surfaces 13 on the closed interior sections of the reflectors 12, and secondary primary reflective surfaces 14 with a general curve or straight section utilizing a highly reflective diffuse finish positioned adjacent to the primary specular surface 13. Adjacent the outside rim of the specular surface 13 and diffuse surface 14 of the primary reflectors 12 may be a diffuse reflecting surface 15 forming a generally curved or straight line, or sections thereof, which may be provided by the reflector 12 housing or enclosure. The diffuse reflective surface 15 may also substitute for the secondary primary diffuse reflective surface 14 as shown in FIG. 4 and act as a secondary primary diffuse reflective surface 24 in and of itself.

Plural reflectors 12 are disposed slightly outside of the ballast housing and wireway channel 16, and are attached using reflector supports 17 which may be stationary or hingedly adjustable in nature. Plural opposed linear lamp sources 18 are placed within the closure formed by the interior specular surfaces 13 and are supported by the socket wireway 19 and lamp sockets 20.

Although FIGS. 1–4 are shown using a single lamp per reflector 12, it should be understood that multiple lamps could be utilized per side should it be so desired and that a single reflector 12 can be utilized. Plural reflectors 12 and ballast housing and wireway channel 16 may be enclosed in a separate or integral housing using surface 15 and fixed therein by means such as struts, rivets, bolts, hinges, or the like (not shown). Surface 15 includes a highly diffuse reflective finish on both its interior and exterior surfaces. The wireway channel 16 is suspended from the ceiling surface by means of a vertical support member 22 either stationary or adjustable in nature.

FIG. 2 illustrates the plural reflectors 12 and plural linear lamp sources 18 in position below a horizontal plane 23 using vertical support 22 to position the luminaire for indirect illumination. It should be understood that the horizontal surface 23 might also represent a vertical or sloped surface, such that reflectors 12 may then be positioned adjacent to the vertical or sloped surface, preferably on a horizontal or angular support member, now illustrated by support 22, for illumination of the surface 23. In either position, the reflectors 12 of the present invention provide substantially constant magnitude of illumination over surface 23 in the 15° to 165° zone from nadir Fl shown as line A/B in FIG. 3. The maximum practical extent angles A and B is about 160°, although it may be varied to more or less than 160° by modifying the primary reflective surface 13 shape and degree of specularity, or by changing the plural reflectors 12 orientation to each other.

Still referring to the plural reflectors 12 shown in FIGS. 1 to 4, the primary surfaces 13 are prefinished to provide an exposed specular (mirror-like) finish. The reflector material and reflecting surface chosen preferably exhibits a specular reflectance factor exceeding approximately 0.90. The secondary primary reflector surface 14 chosen preferably exhibits a diffuse reflectance factor within the range of from approximately 0.80 to 0.90.

Figure 5:
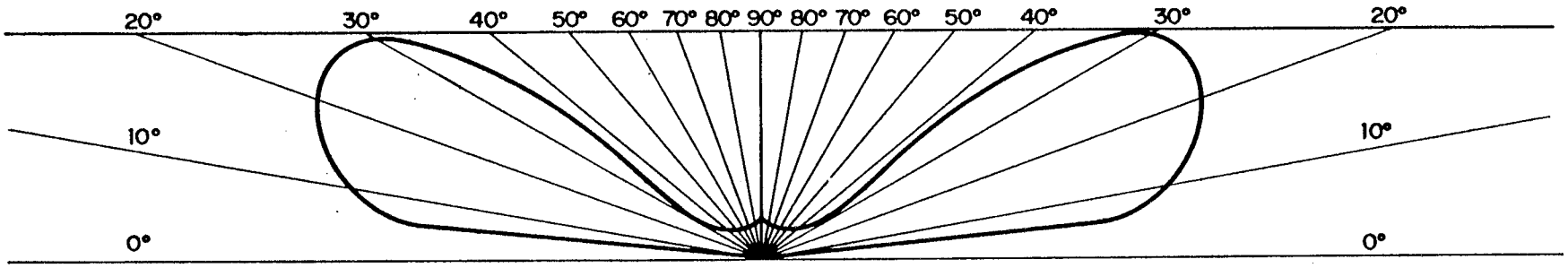
FIG. 5 illustrates a photometric curve (relative candlepower) in a vertical plane through the plural reflectors and luminaire of the present invention.

The direction of reflections from the individual surfaces and operations of the plural reflectors 12 as a whole is evident from a consideration of FIGS. 3 to 5. With reference to FIG. 3, it will be noted that the primary specular reflectors 13 have a first focal point from about 8° to about 25° from nadir F1 indicated as 1A/1B on plane 23. The second focal point of the primary specular reflectors 13 is located just outside the closure formed by drawing an imaginary line, shown as 2E/2F, across the outwardly extending edges of the specular surfaces 13, and is directed towards the secondary primary diffuse reflective surface 14 where it is redirected to the area shown as 2A/2B on plane 23. The closures referred to by 2E/2F extend outward to a point from about 20° to 50° when measured from the lamp sources 18 to an area on plane 23 intersected by lines 2E/2F, thus preventing direct exposure of the lamp source to any area of plane 23 located directly above the luminaire. Any stray beam reflections generated by primary specular reflector 13 and not redirected by secondary primary diffuse reflector 14 shall be redirected by the interior diffuse surface 15 so that all reflections emanating from the present luminaire are eliminated from below the area about 10° to 15° above horizontal as indicated by angle 3A, thus preventing any and all primary light reflections from being viewed directly from below the luminaire.

FIG. 5 shows the approximate relative candlepower distribution provided by the embodiment of FIGS. 1–4 onto surface 23. It should be noted that the intensity at the zenith is extremely low compared to the maximum intensity which occurs at about 125°. This is advantageous since it allows the fixture to be mounted more closely to the ceiling without creating any form of hot spot directly above the fixture, as well as providing for a wider spacing ratio between luminaires.

Figure 6B:
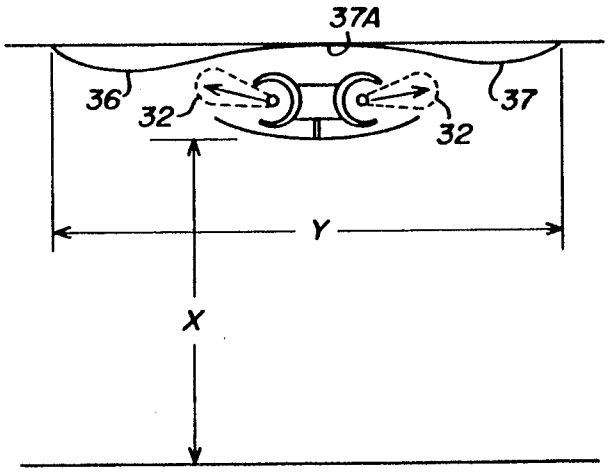
FIGS. 6*a* and 6*b* illustrate a comparison of existing prior art fixtures with the fixtures of the present invention.
Figure 6A:
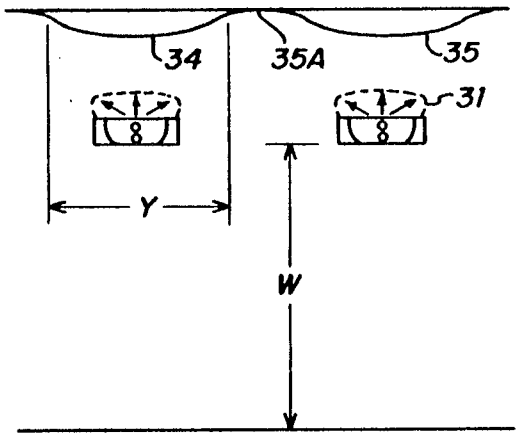
FIG. 6a PRIOR ART

FIG. 6*a* shows a comparison between the cosine distribution, as indicated generally at reference numeral 31, which is characteristic of a traditional fixture and the widespread distribution generally indicated at reference numeral 32 (FIG. 6*b*) that is available with the present invention. As a further comparison, the line 34 (FIG. 6*a*) is a plot of luminance of the ceiling over a traditional fixture showing that the luminance is much more pronounced at the point 35 directly over a fixture than at the midpoint, such as point 35A. Typically, the ratio of the values at point 35 to point 35A is excessive with a traditional fixture when it is suspended less than nine inches below the ceiling. Line 36 (FIG. 6*b*) is a plot of luminance of the ceiling with the fixture of the present invention hung about 4" below the ceiling showing that the luminance is more pronounced at the midpoint 37 than at the point 37A directly over the fixture. The ratio of the values between 37 and 37A is acceptable regardless of the distance of suspension between the fixture of the present invention and the ceiling surface which is being illuminated.

In summary, what has been achieved here is a fixture reflector system which projects maximum luminance outwardly towards the sides of the luminaire while virtually eliminating the bright area directly over the fixture on the ceiling. Thus the present invention may be mounted as closely as 2" below the ceiling surface and still provide superior uniformity when compared with traditional luminaires which expose the lamp source directly to the ceiling above the fixture. In addition, the larger surface area and specular nature of the plural opposed reflectors of the present invention allow for increased candle power being generated by a fixture which achieves over 92% efficiency.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A luminaire for directing light generated by a linear lamp source, having an associated ballast housing and wireway channel, to a reflective surface, comprising:

an asymmetric reflector mounted on a longitudinal axis parallel to and adjacent the linear lamp source, said reflector including an aperture beginning approximately 20° to approximately 50° past a vertical line passing through the axis of the lamp source to a location directly above the luminaire at nadir, such that said reflector produces a uniformly enlarged singular light distribution pattern outwardly of the lamp source on the reflective surface, thereby preventing illumination of the reflective surface directly above the lamp source.

2. The luminaire of claim 1 wherein said reflector includes:

a first surface having a highly specular interior reflective surface not exposed to the reflective surface illuminated by the lamp source; and a second surface continuous with said first surface and having a highly diffuse exterior reflective surface exposed to the reflective surface illuminated by the lamp source.

3. The luminaire of claim 1 and further including:

a reflector mounted below said asymmetric reflector and extending outwardly of said asymmetric reflector and including a highly diffuse surface for directing reflections from said asymmetric reflector to the reflective surface illuminated by the lamp source.

4. The luminaire of claim 1 wherein said asymmetric reflector is hingedly mounted to the ballast housing and wireway channel.

5. A luminaire for directing light generated by a pair of opposed linear lamp sources, having an associated ballast housing and wireway channel, to a reflective surface, comprising:

a pair of asymmetric reflectors mounted on a common longitudinal axis parallel to and adjacent the opposed linear lamp sources, each of said reflectors including an aperture beginning approximately 20° to approximately 50° past a vertical line passing through the axis of a lamp source to a location directly above the luminaire at nadir, such that said reflectors produce a uniformly enlarged singular light distribution pattern outwardly of the lamp sources on the reflective surface, thereby preventing illumination of the reflective surface directly above the lamp sources.

6. The luminaire of claim 5 and further including:

a reflector mounted below said asymmetric reflectors and extending outwardly of said asymmetric reflectors and including a highly diffuse surface for directing reflections from said asymmetric reflectors to the reflective surface illuminated by the lamp sources.

7. The luminaire of claim 5 wherein said asymmetric reflectors are hingedly mounted to the ballast housing and wireway channel.

8. A luminaire for directing light generated by a pair of opposed linear lamp sources, having an associated ballast housing and wireway channel, to a reflective surface, comprising:

a pair of asymmetric reflectors mounted on a common longitudinal axis parallel to and adjacent the opposed linear lamp sources, such that said reflectors produce a uniformly enlarged singular light distribution pattern outwardly of the lamp sources on the reflective surface, thereby preventing illumination of the reflective surface directly above the lamp sources, each of said reflectors including an aperture beginning approximately 20° to approximately 50° past a vertical line passing through the axis of a lamp source to a location directly above the luminaire at nadir;

a first surface having a highly specular interior reflective surface not exposed to the reflective surface illuminated by the lamp sources; and a second surface continuous with said first surface and having a highly diffuse exterior reflective surface exposed to the reflective surface illuminated by the lamp sources.

9. The luminaire of claim 8 and further including:

a reflector mounted below said asymmetric reflectors and extending outwardly of said asymmetric reflectors and including a highly diffuse surface for directing reflections from said asymmetric reflectors to the reflective surface illuminated by the lamp sources.

10. The luminaire of claim 8 wherein said asymmetric reflectors are hingedly mounted to the ballast housing and wireway channel.

11. A luminaire for directing light generated by a linear lamp source, having an associated ballast housing and wireway channel, to a reflective surface, comprising:

an asymmetric reflector mounted on a longitudinal axis parallel to and adjacent the linear lamp source, such that said reflector produces a uniformly enlarged singular light distribution pattern outwardly of the lamp source on the reflective surface, thereby preventing illumination of the reflective surface directly above the lamp source; and a reflector mounted below said asymmetric reflector and extending outwardly of said asymmetric reflector and including a highly diffuse surface for directing reflections from said asymmetric reflector to the reflective surface illuminated by the lamp source.

12. The luminaire of claim 11 wherein said reflector includes:

a first surface having a highly specular interior reflective surface not exposed to the reflective surface illuminated by the lamp source; and a second surface continuous with said first surface and having a highly diffuse exterior reflective surface exposed to the reflective surface illuminated by the lamp source.

13. The luminaire of claim 11 wherein said asymmetric reflector is hingedly mounted to the ballast housing and wireway channel.

14. A luminaire for directly light generated by a pair of opposed linear lamp sources, having an associated ballast housing and wireway channel, to a reflective surface, comprising:

a pair of asymmetric reflectors mounted on a common longitudinal axis parallel to and adjacent the opposed linear lamp sources, such that said reflectors produce a uniformly enlarged singular light distribution pattern outwardly of the lamp sources on the reflective surface, thereby preventing illumination of the reflective surface directly above the lamp sources: and a reflector mounted below said asymmetric reflectors and extending outwardly of said asymmetric reflectors and including a highly diffuse surface for directing reflections from said asymmetric reflectors to the reflective surface illuminated by the lamp sources.

15. The luminaire of claim 14 where said asymmetric reflectors include:

a first surface having a highly specular interior reflective surface not exposed to the reflective surface illuminated by the lamp sources; and a second surface continuous with said first surface and having a highly diffuse exterior reflective surface exposed to the reflective surface illuminated by the lamp sources.

16. The luminaire of claim 14 wherein said asymmetric reflectors are hingedly mounted to the ballast housing and wireway channel.

* * * * *